US005594539A

United States Patent [19]

Murano et al.

[11] Patent Number: 5,594,539

[45] Date of Patent: Jan. 14, 1997

[54] PAPER GUIDE DEVICE FOR IMAGE FORMING APPARATUS

[75] Inventors: Jun'ichi Murano, Sayama; Takaya Muraishi, Yokohama; Hiroshi Tanabe, Tokyo; Kazunori Karasawa, Tokyo; Kazuhiro Nishido, Tokyo; Ichiro Komuro, Yokohama, all of Japan

[73] Assignee: Ricoh Company, Ltd., Tokyo, Japan

[21] Appl. No.: 453,048

[22] Filed: May 26, 1995

[30] Foreign Application Priority Data

Jun. 30, 1994 [JP] Japan ..... 6-150127
Jul. 25, 1994 [JP] Japan ..... 6-172565

[51] Int. Cl.[6] ..... G03G 15/16

[52] U.S. Cl. ..... 399/316

[58] Field of Search ..... 355/271, 273, 355/274, 277, 309

[56] References Cited

U.S. PATENT DOCUMENTS

| | | | |
|---|---|---|---|
| 4,739,362 | 4/1988 | Kau et al. | 355/277 |
| 4,847,652 | 7/1989 | Masuda et al. | 355/274 |
| 4,882,606 | 11/1989 | Deguchi | 355/274 |
| 5,428,431 | 6/1995 | Abe et al. | 355/273 |

FOREIGN PATENT DOCUMENTS

| | | |
|---|---|---|
| 51-19760 | 2/1976 | Japan . |
| 57-128356 | 8/1982 | Japan . |
| 58-52558 U | 4/1983 | Japan . |
| 58-69848 U | 5/1983 | Japan . |
| 60-6158 U | 1/1985 | Japan . |
| 61-126269 U | 8/1986 | Japan . |
| 61-188345 | 8/1986 | Japan . |
| 2-70637 | 3/1990 | Japan . |
| 4-101557 U | 9/1992 | Japan . |
| 6-5313Y2 | 2/1994 | Japan . |

*Primary Examiner*—Joan H. Pendegrass
*Attorney, Agent, or Firm*—Oblon, Spivak, McClelland, Maier & Neustadt, P.C.

[57] ABSTRACT

A paper guide device for guiding a sheet of paper to an image transfer device includes an upper guide plate and a lower guide plate, and an elastic transfer guide plate which is attached to the upper paper guide plate. A free end of the elastic transfer guide plate faces the transfer device and is bent downward such that a bend or crease line is perpendicular to a paper feed direction. The free end of the elastic transfer guide plate is parallel to paper feed direction at a transfer position to better orient/direct the paper as it approaches a photosensitive member or image transfer location. The arrangement allows for a compact paper feed design, while avoiding adverse effects which can occur where paper (particularly thicker paper) springs as it exits a paper guide.

32 Claims, 11 Drawing Sheets

| α | 130° | 135° | 140° | 145° |
|---|---|---|---|---|
| PRESENCE OF AN UNUSUAL TRANSFER WHEN A LINE IMAGE IS FORMED | PRESENCE | PRESENCE | ABSENCE | ABSENCE |
| PRESENCE OF AN UNUSUAL TRANSFER WHEN A CHARACTER IMAGE IS FORMED | PRESENCE | ABSENCE | ABSENCE | ABSENCE |
| RESULT | NG | OK | OK | OK |

PAPER GUIDE DEVICE FOR IMAGE FORMING APPARATUS

BACKGROUND OF THE INVENTION

1. Field of the Invention

The present invention relates to a paper guide device for guiding a sheet of paper to an image transfer location. The invention particularly relates to paper guide devices adapted for use in an image forming apparatus such as a copier, printer, facsimile transceiver or similar image forming apparatus.

2. Description of the Related Art

FIG. 17 depicts a schematic sectional view of a copier. Referring to FIG. 17, a photoconductive drum 1 rotates in a direction indicated by the arrow. A main charger 2, an exposure device 3, a developer device 4, a transfer belt 5, a cleaning device 6 and a discharge lamp 7 are located around the photoconductive drum 1. A sheet of paper stored in a paper feed device 8 is fed toward register rollers 9. The sheet of paper which is at the register rollers 9 is then fed toward the photoconductive drum 1. The sheet of paper is guided by guide plates 10 and a thin straight plate 15 which is made of synthetic resin, and then goes into a transfer location. A toner image on the photoconductive drum 1 is transferred to the sheet of paper at the transfer location, and the sheet of paper is then transported by the transfer belt 5, and discharged to a tray 13 via a fixing device 11 and discharge rollers 13.

The paper feed device 8 is disposed under the photoconductive drum 1, so that the width dimension of the copier is relatively small. However, with the sheet of paper transported upward, the sheet of paper bends when it is fed from the register rollers 9 to the transfer location. If the sheet of paper bends, the rear end of the sheet of paper springs up when it passes through the thin plate 15. The spring action of the rear end of the sheet of paper can cause unusual or undesirable transfer of toner, and as a result, a toner image on the sheet of paper becomes poor. Springing of the rear end of the sheet of paper particularly occurs when the sheet of paper is thick.

FIGS. 18 and 19 depict a copier in which the sheet of paper is transported approximately perpendicular to the photoconductive drum 1. As shown in FIG. 19, if the sheet of paper is transported substantially perpendicular to the photoconductive drum 1, the rear end of the sheet of paper springs in a direction indicated by arrow P. As a result, a toner image on the sheet of paper becomes poor. Particularly, when thick paper (paper of 110 kg) is used, the rear end of the paper springs quite often.

Experimental runs were conducted with a copier as shown in FIG. 20 in which the sheet of paper S is transported almost perpendicular to the photoconductive drum 1 under normal temperature and humidity conditions. A Japanese postal card (paper of 110 kg) was used as the sheet of paper S. The result of the experiment is shown in FIG. 21. As shown in FIG. 21, a toner image at a location spaced from the rear end of the sheet of paper S by a distance q (10 mm to 15 mm) is poor. As shown in FIG. 20, the thin straight plate 15 is disposed on the guide plate 10. When the rear end of the sheet of paper S passes through the thin plate 15, the rear end of the sheet of paper S springs up, and then it strikes a surface of the photoconductive drum 1. When the rear end of the sheet of paper S passes through the thin plate 15, a sound is made, which is an indication that the rear end of the sheet of paper strikes the surface of the photoconductive drum 1. While thick paper passes along a nip portion between the photoconductive drum 1 and the transfer belt 5, the transfer belt 5 is pushed downward. As a result, the front end of the sheet of paper S separates from the transfer belt 5. Therefore, when the rear end of the sheet of paper S passes through the thin plate 15, it springs up hard.

In addition, toner on the surface of the photoconductive drum 1 is scattered by airflow which is generated by the rotation of the photoconductive drum 1. Scattered toner accumulates on the thin plate 15. Therefore, when the rear end of the sheet of paper S springs against the thin plate 15, toner on the thin plate 15 is scattered again, and then adheres to the sheet of paper S. As a result, the quality of a toner image becomes poor.

SUMMARY OF THE INVENTION

Accordingly, an object of the present invention is to provide a paper guide device for an image forming apparatus which can solve the aforementioned conventional drawbacks, and which can improve the quality of the toner image formed on the sheet of paper.

It is another object of the present invention to provide a paper guide device which can reduce the size of the image forming apparatus, or which is suitable for a small-sized apparatus.

These and other objects are achieved according to the present invention by providing a paper guide device for guiding a sheet of paper to an image transfer device in an image forming apparatus. The paper guide device includes a pair of paper guide members, and an elastic transfer guide plate which is attached to at least one of the paper guide members and a free end which faces the transfer device is bent downward along a line perpendicular to the paper feed direction.

BRIEF DESCRIPTION OF THE DRAWINGS

A more complete appreciation of the invention and many of the attendant advantages thereof will be readily obtained as the same becomes better understood by reference to the following detailed description when considered in conjunction with the accompanying drawings, wherein.

DESCRIPTION OF THE PREFERRED EMBODIMENTS

Figure 1:
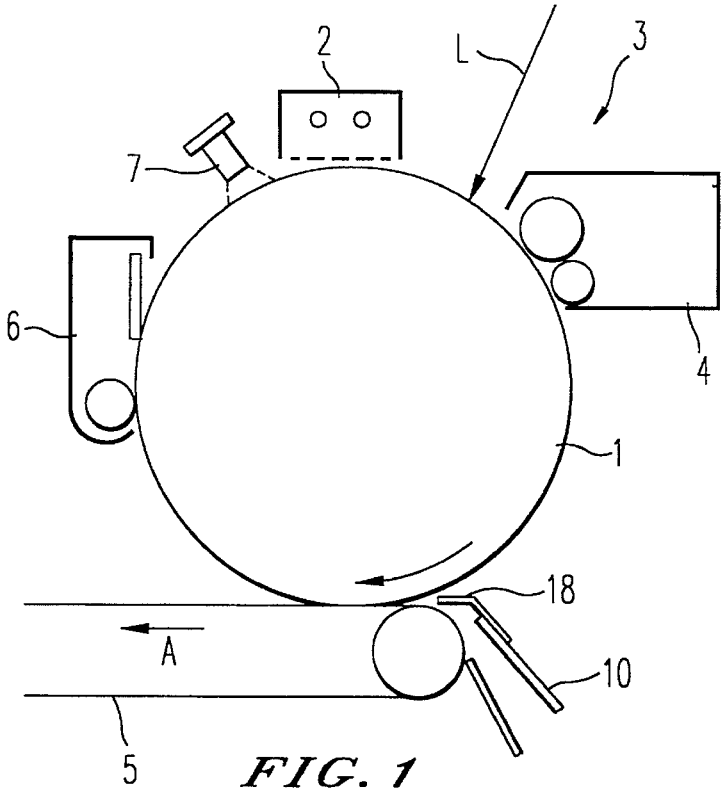
FIG. 1 is a schematic side view of a copier embodying the present invention.

Referring now to the drawings, wherein like reference numerals designate identical or corresponding parts throughout the several views, as shown in FIG. 1, the copier includes a photosensitive drum 1 which is supported by a housing of the copier. The photosensitive drum 1 is driven to rotate in the direction indicated by the arrow, typically at a constant speed.

A surface of the photoconductive drum 1 is uniformly charged by a charger 2. The charged surface of the photosensitive drum 1 is exposed at an exposure portion 3, then an electrostatic latent image is formed on the surface of the photoconductive drum 1. The electrostatic latent image is developed by a developer device 4, and the developed image is transferred to a sheet of paper which is fed from a paper feed device (not shown) and is carried on a transfer belt 5 having a surface which moves in a direction indicated by arrow A. In this embodiment, the paper feed device is located under the photoconductive drum 1. After transferring the image, the sheet of paper is separated from the photoconductive drum 1. The residual toner on the photosensitive drum 1 is cleaned by a cleaning device 6, and then the surface of the photosensitive drum 1 is discharged by a discharger 7.

Figure 2:
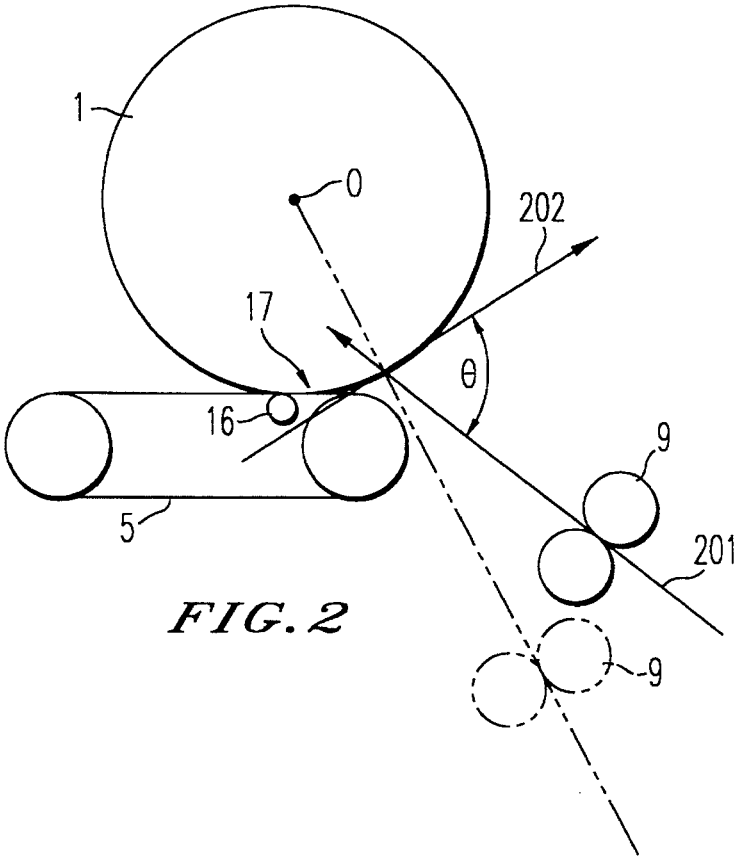
FIG. 2 is a schematic side view of a copier embodying the present invention.

Referring to FIG. 2, a sheet of paper (not shown) which is waiting at register rollers 9 is fed to the photoconductive drum 1. The fed sheet is then carried on the transfer belt 5. A transfer roller 16 makes an electric field at a transfer portion 17, and as a result, a toner image on the photoconductive drum 1 is transferred to the sheet of paper at the transfer portion 17. As shown in FIG. 2, a common tangent line 201 of a pair of resister rollers 9 and a tangent line 202 of the drum 1 which passes through a point of contact between the tangent line 201 and a surface of the drum 1 makes an angle θ. The angle θ thus represents a paper feed angle to the photoconductive drum 1. The paper comes in contact with the photoconductive drum 1 upstream of the nip transfer portion 17 with respect to the paper feed direction. It is desirable that the angle θ=0° when the tangent line 202 is fixed in order to prevent springing of a rear end of the sheet of paper. If the angle is near an angle of 90°, the sheet of paper shocks/disturbs the photoconductive drum 1. As a 10 result, the photoconductive drum 1 vibrates and a front end of the sheet of paper bends. Furthermore, if the copier is a digital image forming apparatus, the position of irradiation of laser beams on the photoconductive drum 1 shifts. To prevent the aforementioned drawbacks, in accordance with the present embodiment, the sheet of paper is fed to the transfer position in a manner which results in feeding similar to an arrangement in which the angle θ=0°. However, the advantage of retaining an arrangement suitable for a small-sized apparatus is maintained.

In order to provide the θ=0° result, a transfer guide plate 18, which preferably is an elastic thin plate, is provided as a transfer plate or exit plate on the front end of guide plate(s) 10 as shown in FIG. 1. The transfer guide plate 18 is bent so as to satisfy the angle θ=0°. More particularly, the transfer guide plate 18 is bent such that the bent portion of the plate 18 is parallel to a common tangential line between the transfer belt 5 and the photoconductive drum 1, i.e., the transfer guide member 18 is bent such that the bent portion of the plate 18 is parallel to the paper feed direction at a transfer position. Thus, the guide plates 10 are positioned parallel to the tangent line 201, and disposed to satisfy the angle relationship $20° \leqq \theta \leqq 90°$ with respect to the tangent line 202 as shown in FIG. 2. The transfer guide plate 18 absorbs any springing of the rear end of the sheet of paper, so that the rear end of the sheet of paper does not spring up to strike the photoconductive drum 1. As a result, the sheet of paper (even if the paper is thick) is fed to the transfer position smoothly. Therefore unusual or undesired transfer of toner is prevented so that a high quality toner image is formed on the sheet of paper.

Figures 3, 4:
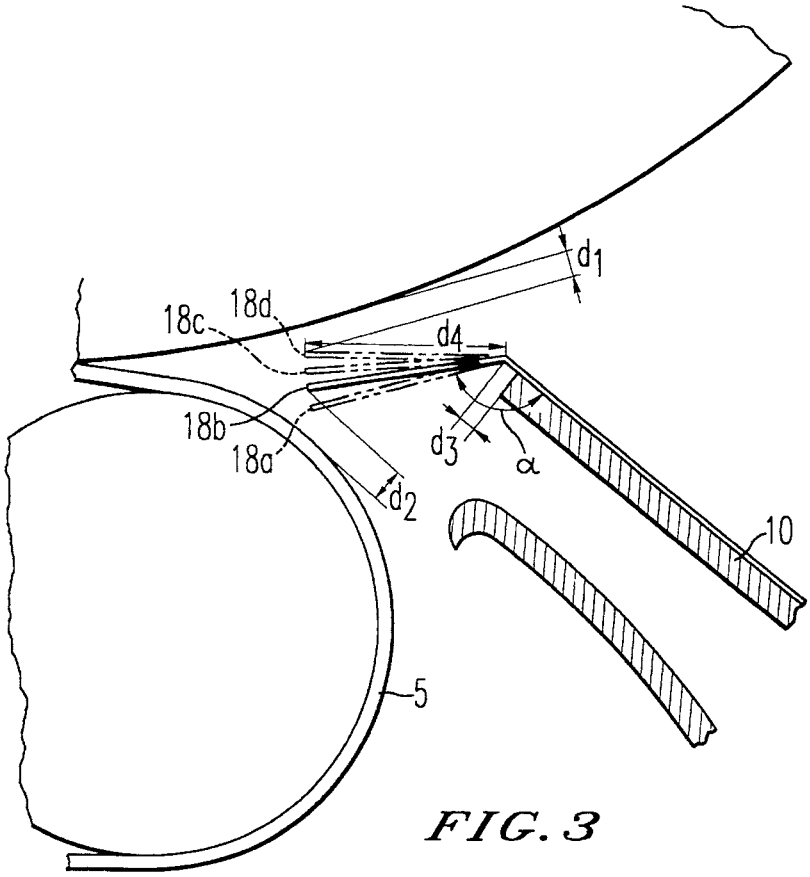
FIG. 3 is a schematic side view of a paper guide device embodying the present invention.
FIG. 4 is a table representing an angle of a thin plate or transfer plate with respect to the guide plates.

In order to satisfy the aforementioned condition, experiments were conducted with respect to a bending angle α of the transfer guide plate 18 under normal temperature and normal humidity conditions. In these experiments, VINYFOIL (polyvinylchloride) having a thickness of 0.33 mm was used as the transfer guide plate 18. The length dimension d4 of the plate 18 from the bend or crease to the leading edge of the plate 18 was 7 mm. A Japanese postal card (paper of 110 kg) was used as the sheet of paper. The guide plates 10 were positioned in parallel to the tangent line 201, with angle θ=51° when the tangent line 202 is fixed as shown in FIG. 3. Referring to FIG. 3, when the angle α is 130°, the transfer guide plate 18 is as shown at plate 18*a*, when the angle α is 135°, the transfer guide plate 18 is as shown at plate 18*b*, when the angle α is 140°,the transfer guide plate 18 is as shown at plate 18*c*, and when the angle α is 145°, the transfer guide plate 18 is as shown at plate 18*d*. A minimum gap d1 provided between the surface of the photoconductive drum 1 and the transfer guide plate 18*d* is 0.7 mm, and a minimum gap d2 between the surface of the transfer belt 5 and the transfer guide plate 18*a* is 1.12 mm. Dimensions d3 between the bent line of the transfer guide plate 18 and the front end portion of the guide plate 10 is 0.5 mm. If the gap d1 is less than 0.7 mm, the transfer guide plate 18 may come in contact with the photoconductive drum 1. If the gap d2 is less than 1.12 mm, the transfer guide plate 18 may come in contact with the transfer belt 5.

The result of the experimentation is shown in FIG. 4. In FIG. 4, a line image is an image which is formed perpendicular to a paper transport direction and has a thickness of two dots of a laser beam. As shown in FIG. 4, when the bending angles α are 140° and 145°, a transfer image on the sheet of paper is good in quality. When the bending angle α is 135°, an undesired transfer occurs when a line image is formed. However a transferred image on the sheet of paper is of good quality when a character image is formed.

Therefore the angle α of 135° is also acceptable. In accordance with the present embodiment, when the bending angle α is from 135° to 145°, the sheet of paper is transported smoothly and a toner image on the sheet of paper is of good quality. Further, it is more desirable that the angle α is between 140° and 145°.

Figure 5:
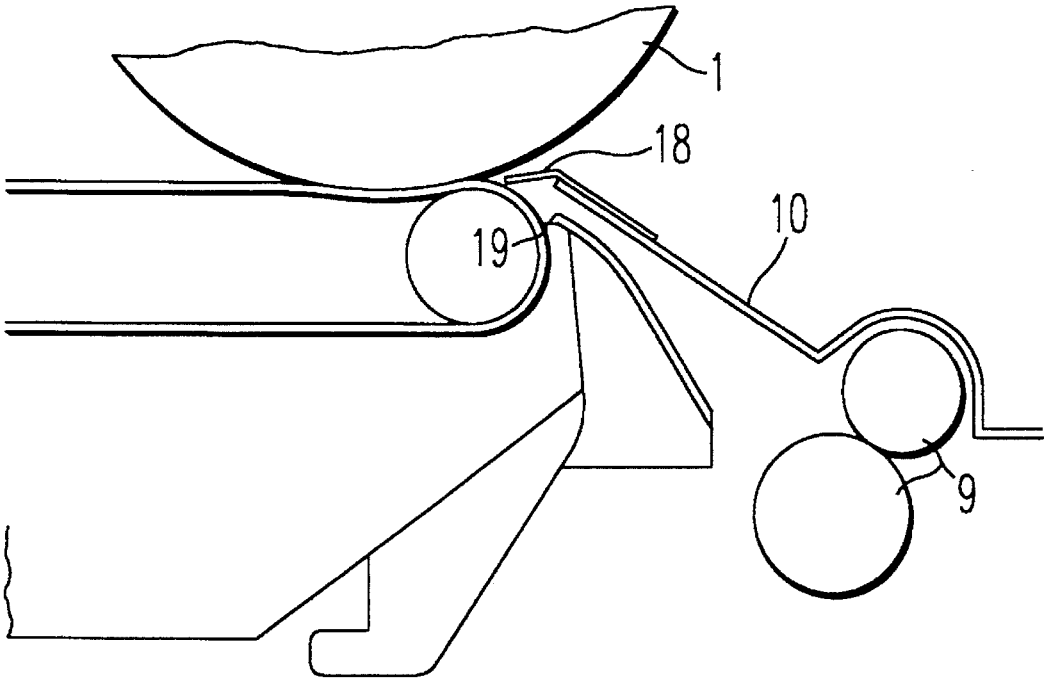
FIG. 5 is a partial side view of a copier embodying the present invention.

Referring to FIG. 5, the transfer guide plate 18 is stuck on the upper guide plate 10 by a double-sided adhesive tape. In this embodiment, DIALAMY (polyethylene terephthalate) with a thickness of 0.2 mm is used as the transfer guide plate 18. A transfer guide plate 19 is also stuck on the lower assistant guide plate 10. It is also possible to use VINYFOIL (polyvinyl chloride) having a thickness of 0.3 mm as the transfer guide plates 18 and 19 instead of DIALAMY. It is likely that other materials could also be utilized consistent with the teachings of the present invention. When the transfer guide plates 18 and 19 are made of synthetic resin, processing becomes easier and the cost is lower. It is also possible to use a metallic thin plate, for example a stainless steel plate having thickness, for example, from 0.1 mm to 0.3 mm, as the transfer guide plates 18 and 19.

Figure 6:
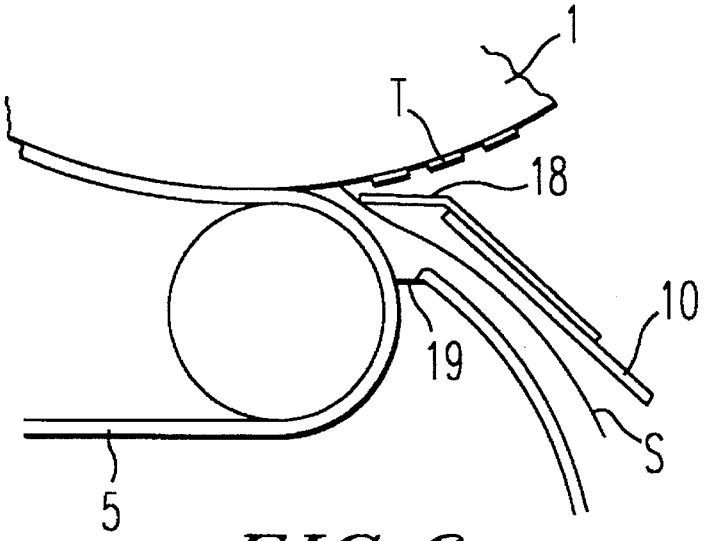
FIG. 6 is a schematic side view showing a state of a front end of paper which is guided by the paper guide device.
Figure 7:
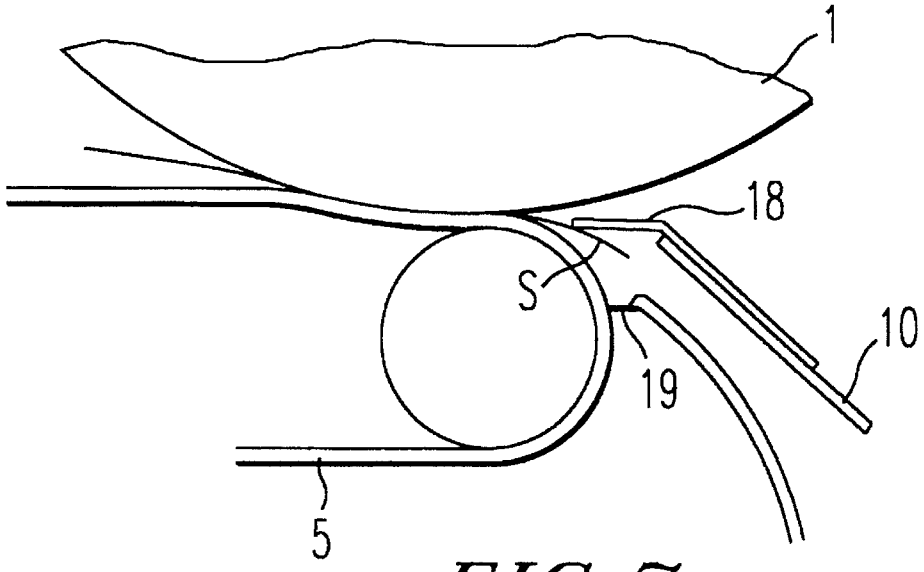
FIG. 7 is a schematic side view showing a state of a rear end of paper which is guided by the paper guide device.

FIGS. 6 and 7 show the transportation of the sheet of paper by the transfer guide plate 18. Referring to FIG. 6, since the front end of the sheet of paper S is guided by the front end of the transfer guide plate 18, the front end of the sheet of paper S is coincident with an image area on the photoconductive drum 1, even if the front end of the sheet of paper S curls up or had a curl therein. Referring to FIG. 7, the transfer guide plate 18 absorbs the spring action of the rear end of the sheet of paper S. As a result, the rear end of the sheet of paper does not strike the photoconductive drum 1. Therefore, the undesired transfer of toner is prevented, so that a good quality toner image is formed on the sheet of paper.

Figure 8A:
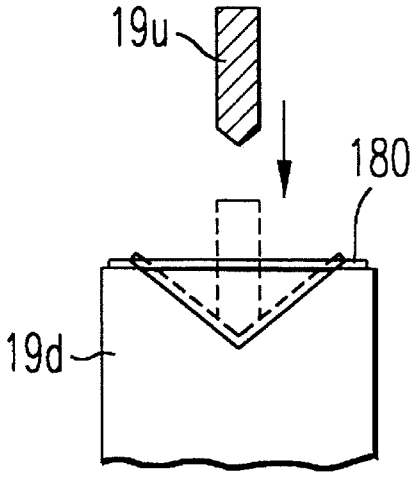
FIG. 8 shows a method of bending a thin plate or transfer plate.
Figure 8B:
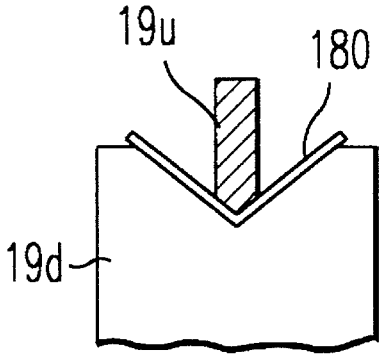

Next, a bending process of the transfer guide plate 18 will be described. Referring to FIG. 8(*a*), a material 180 of the transfer guide plate 18 is put on a die 19*d*, then a heated die 19*u* is moved in a direction indicated the arrow and presses upon the material 180 (FIG. 8*b*). The die 19*u* applies heat to the material 180 while it presses the material 180. A temperature of the die 19*u* is preferably higher than the melting point of the material 180. As a result, the transfer guide plate 18 maintains a bent form. In this embodiment, PVC or PET are used as the material 180, however other materials are possible.

Figure 9:
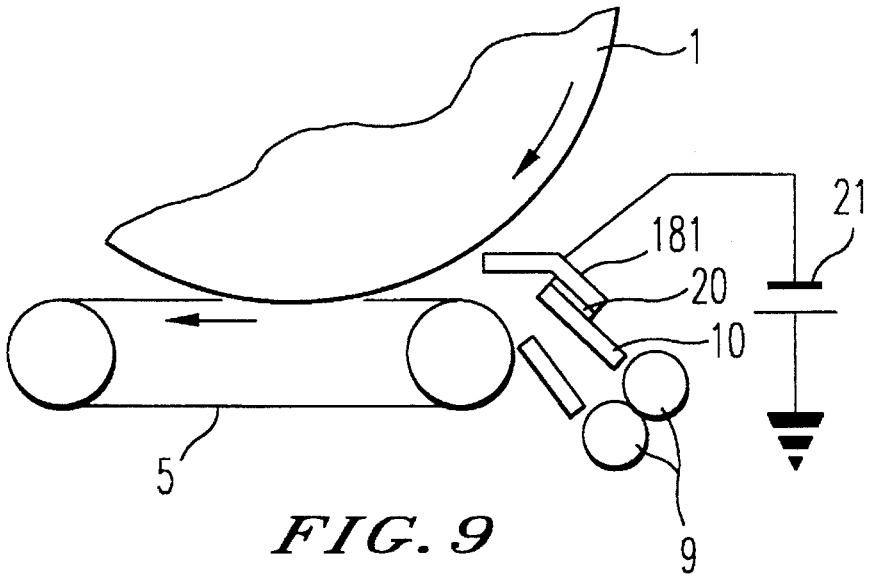
FIG. 9 is a schematic side view showing a paper guide member in which a bias voltage is applied to a transfer plate.
Figure 10:
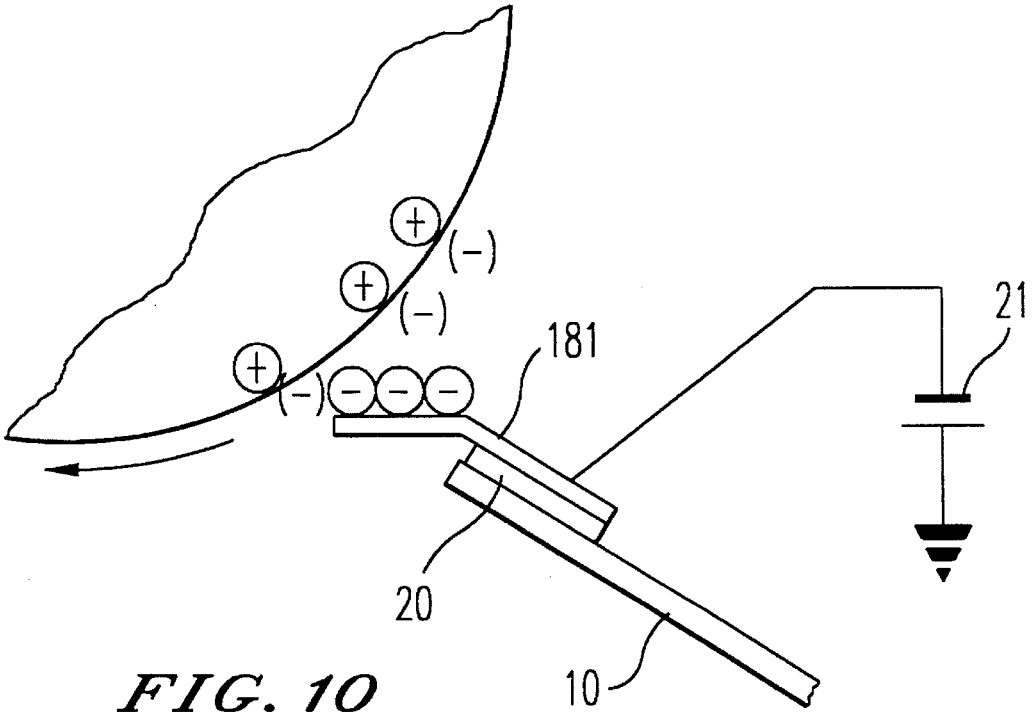
FIG. 10 is a schematic side view showing the paper guide device in which a bias voltage is applied to the transfer plate.

FIGS. 9 and 10 depict a modified embodiment of the transfer guide plate 18. Referring to FIGS. 9 and 10, a transfer guide plate 181, which is formed of a conductive material such as a metallic plate, is adhered to the guide plate 10 with an insulating glue 20. A power source 21 is connected to the transfer guide plate 181 and applies a bias voltage to the transfer guide plate 181. The polarity of the bias voltage is the same as that of the toner, e.g. a negative polarity. Since the transfer guide plate 181 is charged with a negative potential, the toner which is charged with a negative potential is not adhered to the transfer guide plate 181. Since the toner does not accumulate on the transfer guide plate 181, if a rear end of a sheet of paper springs against the transfer guide plate 181, toner does not drop onto the sheet of paper. Therefore a toner image on the sheet of paper is not deteriorated by undesired toner.

Figure 11:
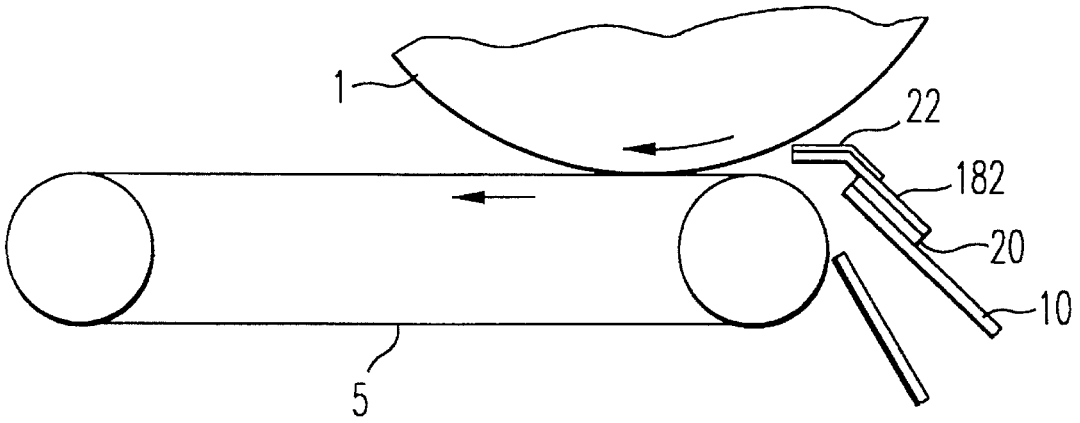
FIG. 11 is a schematic side view showing a paper guide device in which a thin transfer plate is coated with a material which is charged to the same polarity as toner.

FIG. 11 depicts another modified embodiment of the transfer guide plate 18. Referring to FIG. 11, fluorine resin 22 such as TEFLON (polytetrafluoroethylene) is coated on the surface of the transfer guide plate 182. It is also possible to stick TEFLON tape onto the surface of the transfer guide plate 182. Since TEFLON 22 is charged with a negative potential (by friction as the paper rubs against the TEFLON), toner which is also charged with a negative potential does not adhere to the transfer guide plate 182. Since toner does not accumulate on the transfer guide plate 182, if a rear end of a sheet of paper springs against the transfer guide plate 182, toner does not drop onto the sheet of paper. Therefore, a toner image on the sheet of paper is of good quality, and is not deteriorated by undesired toner. It is also possible to use celluloid or sulfur materials instead of a fluorine resin.

Figure 12:
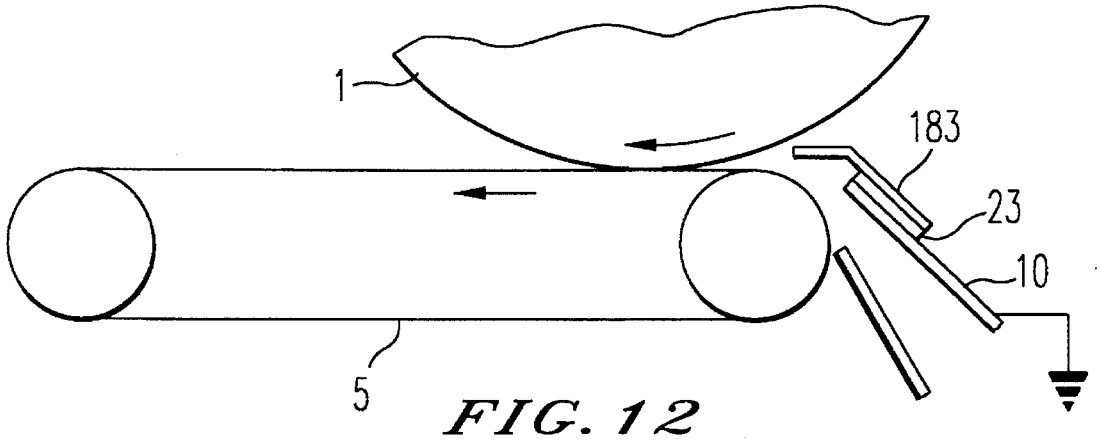
FIG. 12 is a schematic side view showing a paper guide device in which a thin transfer plate is grounded.
Figure 13:
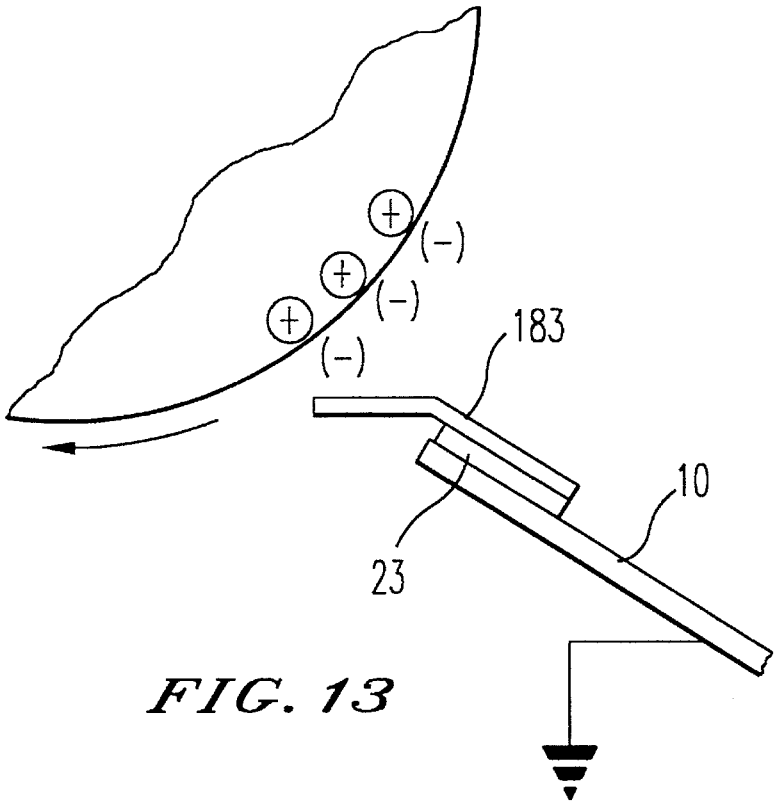
FIG. 13 is a schematic side view showing the paper guide device in which the thin transfer plate is grounded.

Yet another modified embodiment of the transfer guide plate 18 will now be discussed. Toner on the surface of the photoconductive drum 1 is charged and is electrostatically adhered to the photoconductive drum 1. If a transfer guide plate 18 is charged stronger than the photoconductive drum 1, toner on the surface of the photoconductive drum 1 is transferred to the transfer guide plate 18 and then accumulates on the transfer guide plate 18. In accordance with the present embodiment, as shown in FIGS. 12 and 13, the transfer guide plate 183, which is made of a conductive material, is stuck on the conductive guide plate 10 with a conductive glue 23. The guide plate 10 is ground. As a result, the transfer guide plate 183 is discharged and power (or charge) to attract toner does not occur. Therefore toner does not accumulate on the transfer guide plate 183. Furthermore when a sheet of paper passes through the transfer guide plate 183, the transfer guide plate 183 is not charged by friction between the sheet of paper and the transfer guide plate 183. Thus, the present embodiment avoids the accumulation of charges so that such charges will not attract toner. It is also possible to ground the transfer guide plate 183 directly.

Figure 14:
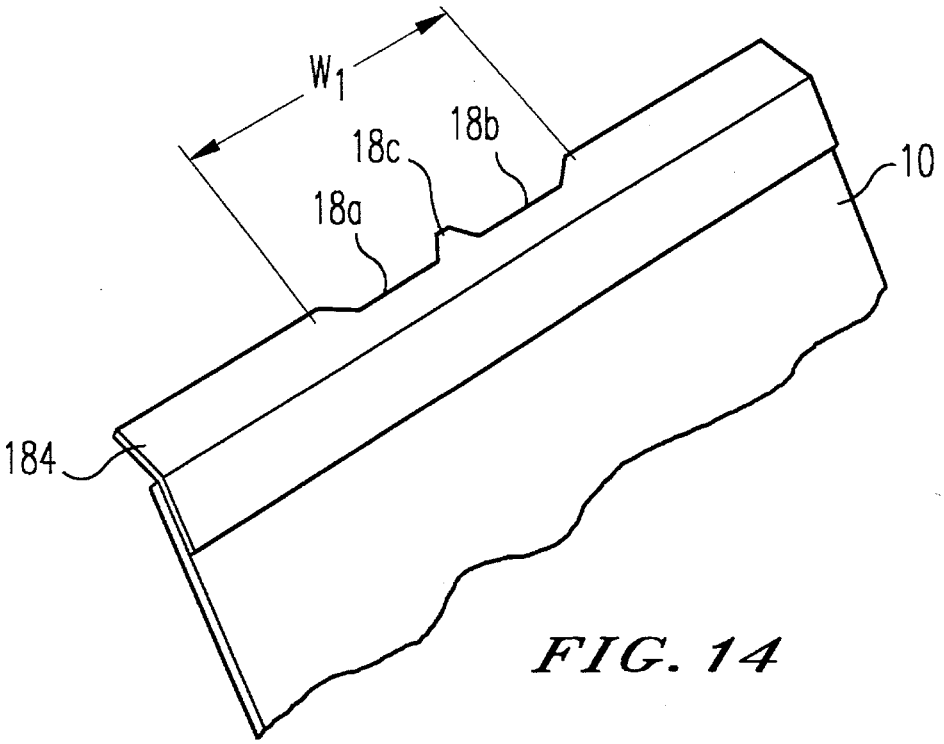
FIG. 14 is a perspective view of a transfer plate of a modified embodiment embodying the present invention.

FIG. 14 depicts a further modified embodiment of the transfer guide plate 18. Referring to FIG. 14, notches 18*a* and 18*b*, and a projection 18*c* are formed on a free end of the transfer guide plate 184. Width dimension W1 is a little shorter than the dimensions of a Japanese postal card (100 mm). The reason why the width dimension W1 is slightly shorter than the dimensions of a Japanese postal card is that the postal card is the heaviest among paper which is usually used in an image forming apparatus, and therefore springs hard against the transfer guide plate. Since toner which is scattered from the photoconductive drum 1 drops through notches 18*a* and 18*b*, toner does not accumulate on the transfer guide plate 184. As a result, if a rear end of a sheet of paper springs against the transfer guide plate 184, toner does not drop onto the sheet of paper. Therefore a toner image on the paper is not adversely affected. Meanwhile the projection 18*c* absorbs the spring action of the rear end of the sheet of paper and prevents unusual (undesired) transfer of toner.

Figure 15:
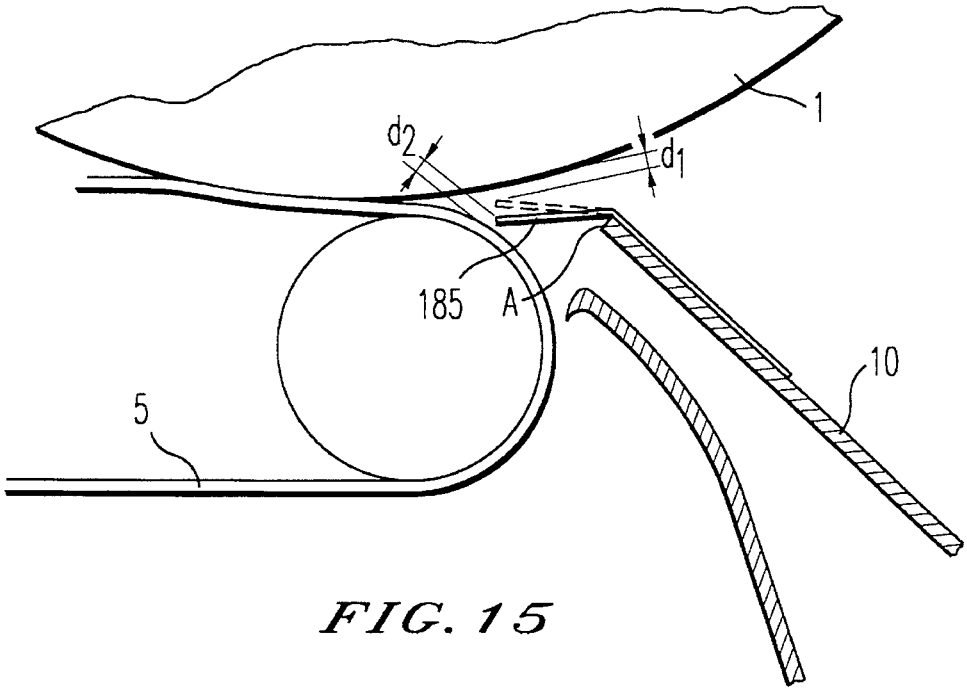
FIG. 15 is a schematic side view showing gaps between an end portion of a thin plate and a surface of a photoconductive drum and between the end portion of the thin plate and a transfer belt.
Figure 16:
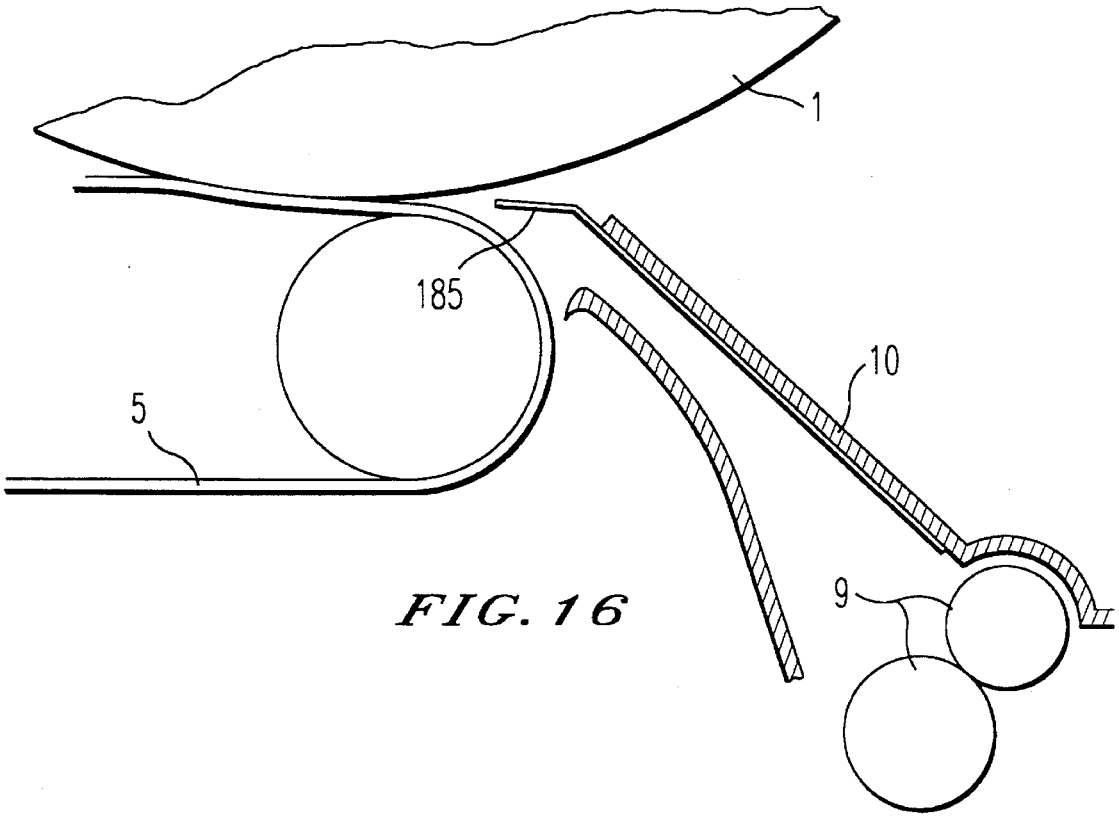
FIG. 16 is a schematic side view of a modified embodiment of a paper guide member embodying the present invention.
Figure 17:
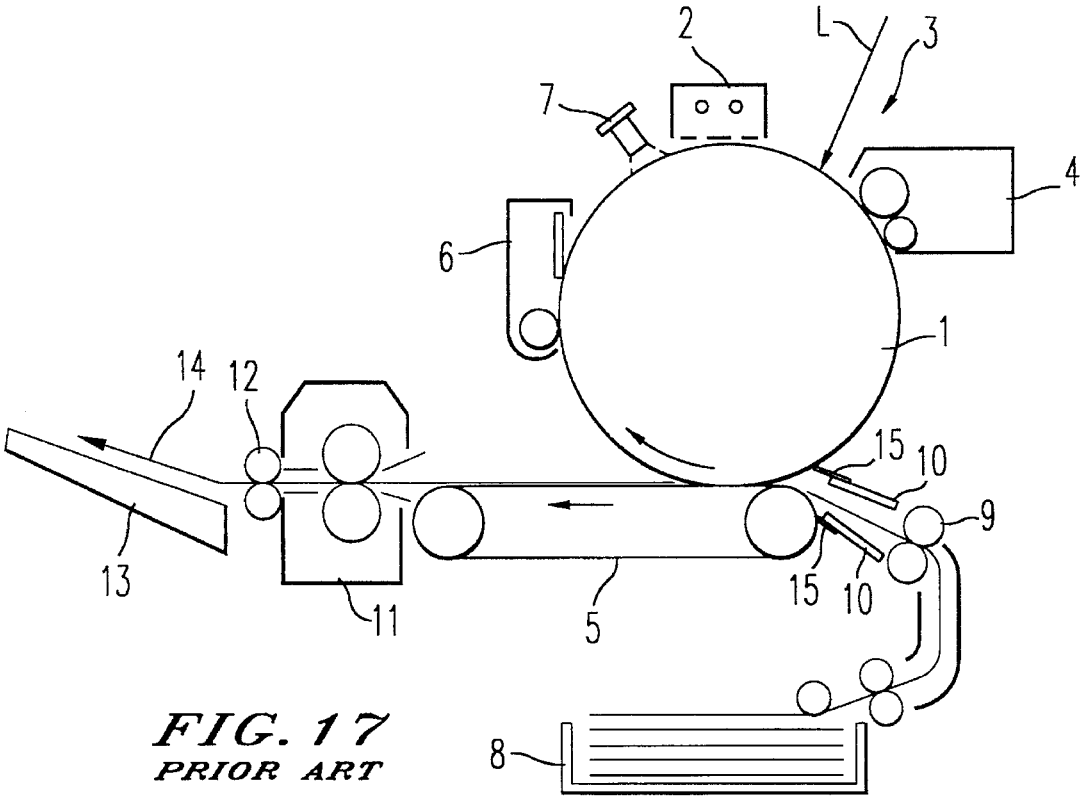
FIG. 17 PRIOR ART
FIG. 17 is a schematic side view of a copier in accordance with a conventional prior art arrangement.
Figure 18:
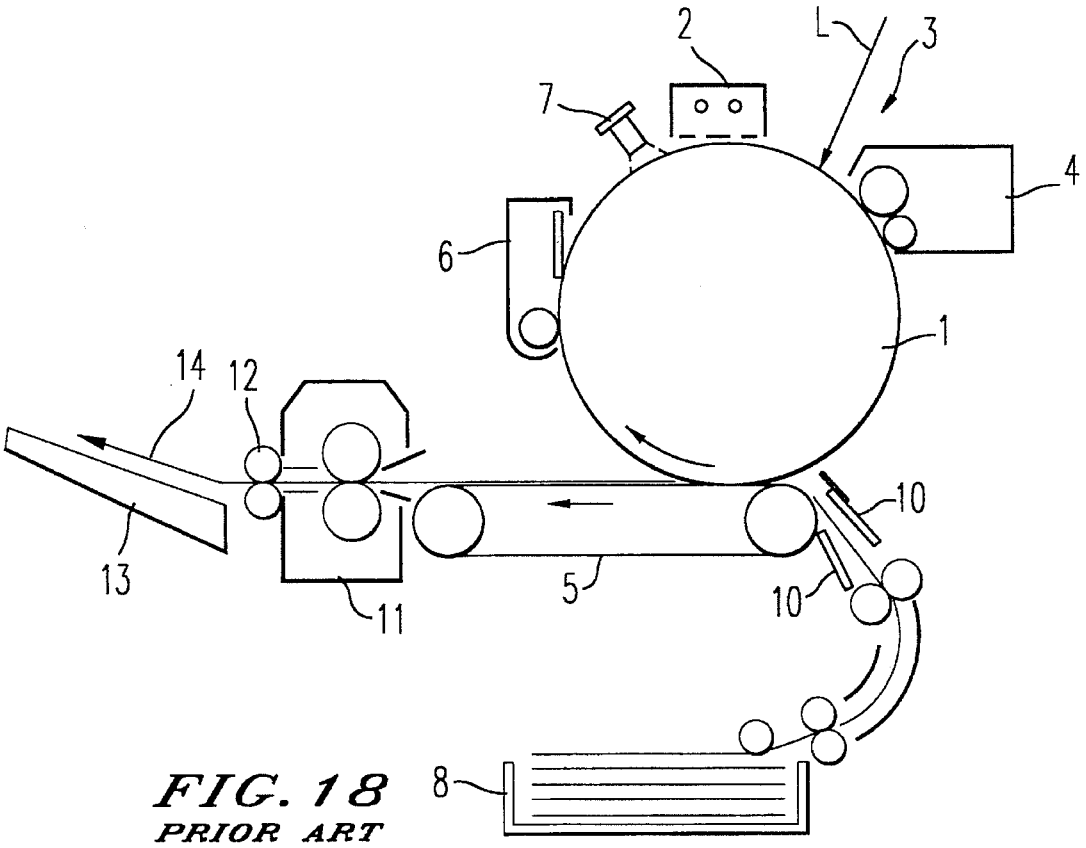
FIG. 18 PRIOR ART
FIG. 18 is a schematic side view of the copier in accordance with a conventional prior art arrangement.
Figure 19:
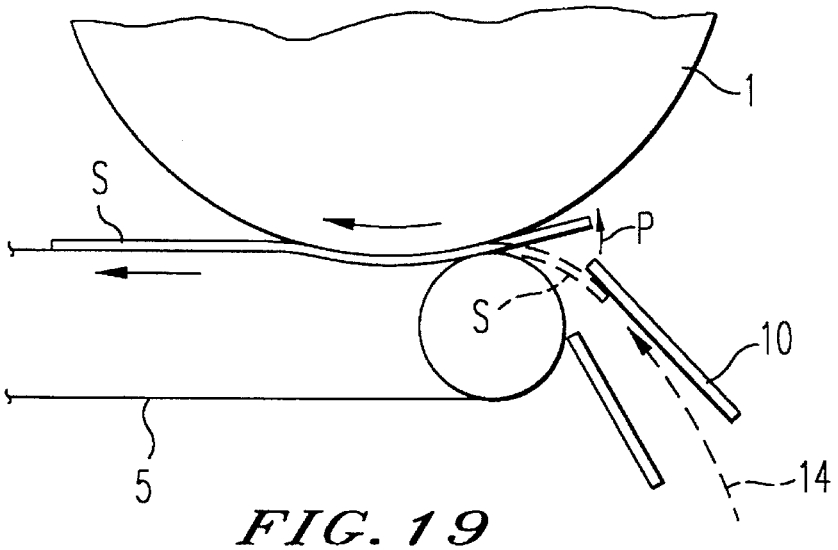
FIG. 19 PRIOR ART
FIG. 19 is a schematic side view depicting the rear end of paper spring upwardly upon exiting the paper guides.
Figure 20:
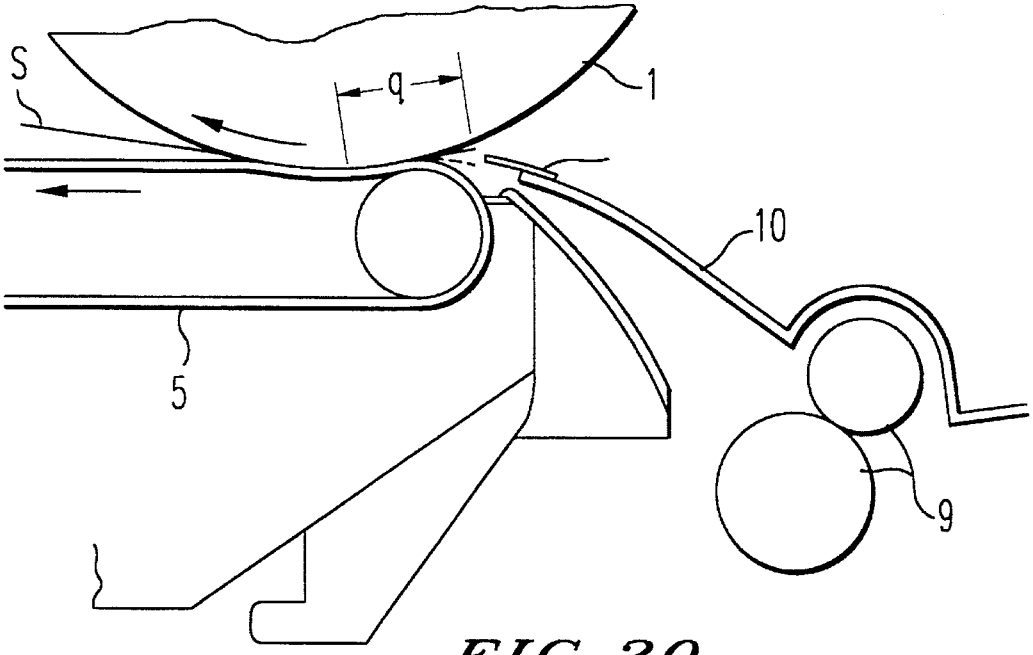
FIG. 20 PRIOR ART
FIG. 20 shows a transport state of paper in accordance with a conventional prior art arrangement.
Figure 21:
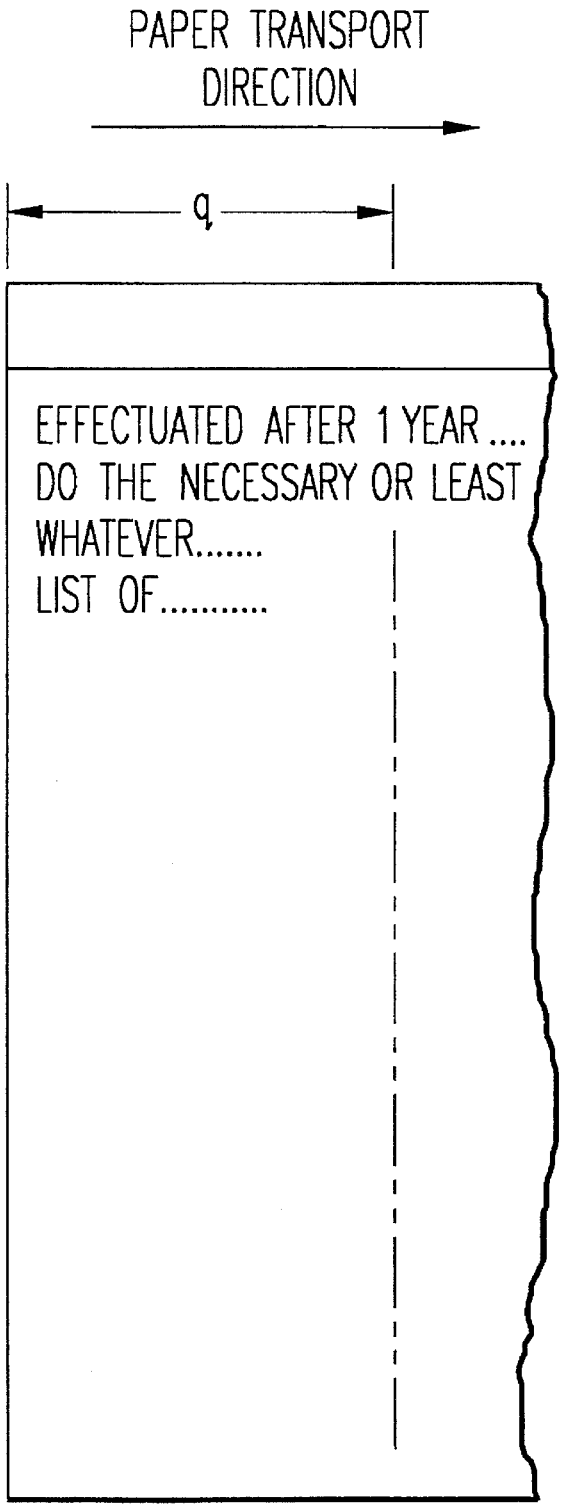
FIG. 21 PRIOR ART
FIG. 21 shows an image on paper in accordance with a conventional prior art arrangement.

FIG. 15 depicts a still further modified embodiment of the transfer guide plate 18. Referring to FIG. 15, stainless steel 185, having a thickness from 0.1 mm to 0.3 mm, is used as a transfer guide plate 18. Since the stainless steel 185 bends less than resin, it is desirable to position the stainless steel accurately to satisfy the minimum gaps d1 and d2 as discussed earlier with reference to FIG. 3. In the present embodiment, the rear end of the sheet of paper (not shown) springs just a little at the difference in level A at the end of the guide 10 (i.e. between the guide 10 and the transfer guide 185). In order to prevent the springing action at the interface (of the guide 10 and transfer guide 185), the transfer guide plate 185 can be mounted on an inside surface of the assistant guide plate 10 as shown in FIG. 16. In this arrangement, the transfer guide plate 185 extends further toward the register rollers 9 on the inside of the guide plate 10. Therefore, the front end of the sheet of paper does not strike the transfer guide plate 185 and the sheet of paper is transported smoothly.

It is also possible to combine various aspects/features of the embodiments described herein with one another within the teachings of the present invention.

Obviously, numerous modifications and variations of the present invention are possible in light of the above teachings. It is therefore to be understood that within the scope of the appended claims, the invention may be practiced otherwise than as specifically described herein.

What is claimed is as new and is desired to be secured by Letters Patent of the United States is:

1. A paper guide device for guiding a sheet of paper to an image transfer device in an image forming apparatus, comprising:

a pair of paper guide members; and an elastic transfer guide plate which is attached to one of said paper guide members at a free end of said one of said paper guide members which faces said transfer device, wherein said elastic transfer guide plate is bent downward along a bending line, and wherein said bending line is perpendicular to a paper feed direction;

wherein a bending angle of said elastic transfer guide plate is from 135° to 145°.

2. The paper guide device of claim 1, wherein said elastic transfer guide plate is bent such that said elastic transfer guide plate is parallel to a paper feed direction at a transfer position of said image transfer device.

3. The paper guide device of claim 1, wherein said elastic transfer guide plate is a metallic plate.

4. The paper guide device of claim 3, wherein a thickness of said metallic plate is from 0.1 mm to 0.3 mm.

5. The paper guide device of claim 4, wherein said metallic plate is stainless steel.

6. The paper guide device of claim 1, wherein said elastic transfer guide plate is coated with material which is charged to the same polarity as toner which is electrostatically adhered to a image bearing member.

7. A paper guide device for guiding a sheet of paper to an image transfer device in an image forming apparatus, comprising:

a pair of paper guide members; and an elastic transfer guide plate which is attached to one of said paper guide members at a free end of said one of said paper guide members which faces said transfer device, wherein said elastic transfer guide plate is bent downward along a bending line, and wherein said bending line is perpendicular to a paper feed direction;

wherein said elastic transfer guide plate is a metallic plate having a thickness of from 0.1 mm to 0.3 mm, and further wherein said pair of paper guide members comprises an upper guide member and a lower guide member, and said metallic plate is attached to said upper guide member on a surface of said upper guide member which faces said lower guide member.

8. A paper guide device for guiding a sheet of paper to an image transfer device in an image forming apparatus, comprising:

a pair of paper guide members; and an elastic transfer guide plate which is attached to one of said paper guide members at a free end of said one of said paper guide members which faces said transfer device, wherein said elastic transfer guide plate is bent downward along a bending line, and wherein said bending line is perpendicular to a paper feed direction;

the paper guide device further comprising a power source which applies a bias voltage to said elastic transfer guide plate, the bias voltage having the same polarity as toner which is electrostatically disposed on an image bearing member, and wherein said elastic transfer guide plate is a conductive member and is disposed on an insulating support.

9. A paper guide device for guiding a sheet of paper to an image transfer device in an image forming apparatus, comprising:

a pair of paper guide members; and an elastic transfer guide plate which is attached to one of said paper guide members at a free end of said one of said paper guide members which faces said transfer device, wherein said elastic transfer guide plate is bent downward along a bending line, and wherein said bending line is perpendicular to a paper feed direction;

wherein said elastic transfer guide plate is a conductive member and is grounded.

10. A paper guide device for guiding a sheet of paper to an image transfer device in an image forming apparatus, comprising:

a pair of paper guide members; and an elastic transfer guide plate which is attached to one of said paper guide members at a free end of said one of said paper guide members which faces said transfer device, wherein said elastic transfer guide plate is bent downward along a bending line, and wherein said bending line is perpendicular to a paper feed direction;

wherein at least one notch is formed on a free end of said elastic transfer guide plate.

11. The paper guide device of claim 10, wherein two notches are formed on a free end of said elastic transfer guide plate and at least one projection is formed between said two notches.

12. The paper guide device of claim 11, wherein a combined width dimension of said two notches is less than 100 mm.

13. A paper guide device for guiding a sheet of paper to an image transfer device in an image forming apparatus, comprising:

a pair of paper guide members; and an elastic transfer guide plate which is attached to one of said paper guide members at a free end of said one of said paper guide members which faces said transfer device, wherein said elastic transfer guide plate is bent downward along a bending line, and wherein said bending line is perpendicular to a paper feed direction;

wherein said elastic transfer guide plate is a heat softenable film and is formed in a heated press.

14. An image forming apparatus for forming a toner image on a sheet of paper, comprising:

an image bearing member for forming a toner image thereon;

a paper feed device which is located under said image bearing member;

a transfer device which transfers a toner image from said image bearing member to said sheet of paper;

a pair of paper guides disposed upstream of said transfer device with respect to a paper feed direction; and a transfer guide plate which is attached to one of said pair of paper guides, said transfer guide plate including a free end which is located between said transfer device and said one of said pair of paper guides, and said transfer guide plate is bent downward along a bending line such that said bending line is perpendicular to the paper feed direction;

wherein said transfer guide plate is bent such that said free end is parallel to a paper feed direction at a transfer position.

15. An image forming apparatus for forming a toner image on a sheet of paper, comprising:

an image bearing member for forming a toner image thereon:

a paper feed device which is located under said image bearing member;

a transfer device which transfers a toner image from said image bearing member to said sheet of paper;

a pair of paper guides disposed upstream of said transfer device with respect to a paper feed direction; and a transfer guide plate which is attached to one of said pair of paper guides, said transfer guide plate including a free end which is located between said transfer device and said one of said pair of paper guides, and said transfer guide plate is bent downward along a bending line such that said bending line is perpendicular to the paper feed direction;

wherein said transfer guide plate is a metallic plate having a thickness from 0.1 mm to 0.3 mm.

16. The image forming apparatus of claim 15, wherein at least one notch is formed on said free end of said metallic plate.

17. The paper guide device of claim 16, wherein two notches are formed on said free end of said metallic plate and at least one projection is formed between said two notches.

18. The paper guide device of claim 17, wherein a combined width dimension of said two notches is less than 100 mm.

19. A paper guide device for guiding a sheet of paper to an image transfer device in an image forming apparatus, comprising:

a pair of paper guide members including an upper guide member and a lower guide member; and an elastic transfer guide plate which is attached to a paper feed side of said upper paper guide member, said elastic transfer guide plate including a free end which faces said transfer device, wherein said free end is bent downward along a bending line which is perpendicular to a paper feed direction.

20. The paper guide device of claim 19, wherein said elastic transfer guide plate is bent such that said free end is parallel to a paper feed direction at a transfer position.

21. The paper guide device of claim 20, wherein at least one notch is formed on a free end of said elastic transfer guide member.

22. The paper guide device of claim 19, wherein at least one notch is formed on the free end of said elastic transfer guide plate.

23. The paper guide device of claim 19, wherein two notches are formed on the free end of said elastic transfer guide plate, and at least one projection is disposed between said two notches.

24. The paper guide device of claim 23, wherein a combined width dimension of said two notches is less than 100 mm.

25. An image forming apparatus comprising:

image transfer means for transferring a toner image to a sheet of paper;

a paper guide upstream of said image transfer means;

a transfer guide including a first end connected to said paper guide and a second free end disposed between said paper guide and said image transfer means, said transfer guide having a different angular orientation with respect to the image transfer means than said paper guide;

wherein said transfer guide is bent along a bending line, said bending line disposed between said first end and said second free end.

26. The image forming apparatus of claim 23, wherein said transfer guide is elastic.

27. The image forming apparatus of claim 25, wherein said bending line extends perpendicular to a paper feed direction.

28. The image forming apparatus of claim 25, further including means for supplying a charge to said transfer guide, said charge having the same polarity as a charge of toner transferred by said image transfer means.

29. The image forming apparatus of claim 25, wherein said paper guide is disposed at a first angle with respect to a tangent of an image bearing member of said image transfer means at a transfer location, and said transfer guide is disposed at a second angle with respect to said tangent, and wherein said first angle is larger than said second angle.

30. A paper guide device in an image forming apparatus comprising:

image transfer means for transferring a toner image to a sheet of paper;

a paper guide upstream of said image transfer means; and a transfer guide including a first end connected to said paper guide and a second free end disposed between said paper guide and said image transfer means, and wherein said transfer guide comprises one of (a) and (b) as follows:

(a) a transfer guide plate having a power source connected thereto which applies a bias voltage to said transfer guide plate, the bias voltage having the same polarity as toner which is electrostatically disposed on an image bearing member, and wherein said transfer guide plate is a conductive member disposed on an insulating support, and (b) a transfer guide plate which is a grounded conductive member;

wherein said transfer guide includes at least one notch formed on a free end of the transfer guide.

31. A paper guide device in an image forming apparatus comprising:

image transfer means for transferring a toner image to a sheet of paper;

a paper guide upstream of said image transfer means; and a transfer guide including a first end connected to said paper guide and a second free end disposed between said paper guide and said image transfer means, and wherein said transfer guide comprises one of (a) and (b) as follows:

(a) a transfer guide plate having a power source connected thereto which applies a bias voltage to said transfer guide plate, the bias voltage having the same polarity as toner which is electrostatically disposed on an image bearing member, and wherein said transfer guide plate is a conductive member disposed on an insulating support, and (b) a transfer guide plate which is a grounded conductive member;

wherein two notches are formed on a free end of said transfer guide, and at least one projection is formed between said two notches.

32. The paper guide device of claim 31, wherein a combined width dimension of said two notches is less than 100 mm.

* * * * *